US010758026B2

(12) United States Patent
Leonard

(10) Patent No.: US 10,758,026 B2
(45) Date of Patent: Sep. 1, 2020

(54) COSMETIC DEVICE HAVING LEAKTIGHT COMPARTMENTS

(71) Applicant: L'OREAL, Paris (FR)

(72) Inventor: Alexis Leonard, Paris (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 15/553,929

(22) PCT Filed: Feb. 25, 2016

(86) PCT No.: PCT/EP2016/054036

§ 371 (c)(1),
(2) Date: Aug. 25, 2017

(87) PCT Pub. No.: WO2016/135272

PCT Pub. Date: Sep. 1, 2016

(65) Prior Publication Data

US 2018/0042359 A1 Feb. 15, 2018

(30) Foreign Application Priority Data

Feb. 27, 2015 (FR) ..... 15 51682

(51) Int. Cl.

| | |
|---|---|
| ***A45D 40/24*** | (2006.01) |
| ***A45D 40/26*** | (2006.01) |
| ***B65D 51/32*** | (2006.01) |

(52) U.S. Cl.

CPC ..... *A45D 40/24* (2013.01); *A45D 40/265* (2013.01); *B65D 51/32* (2013.01); *A45D 2200/051* (2013.01)

(58) Field of Classification Search

CPC .. A45D 40/24; A45D 40/00; A45D 2200/051; A45D 40/265; B65D 51/32

USPC ..... 206/581, 385, 15.3; 132/294, 314, 313, 132/317, 318; 220/506

See application file for complete search history.

(56) References Cited

U.S. PATENT DOCUMENTS

| | | | | |
|---|---|---|---|---|
| 675,971 A | | 6/1901 | Raymond, 2d. | |
| 3,464,599 A | * | 9/1969 | Meth | B43L 25/00 222/589 |
| 5,242,232 A | | 9/1993 | Kuhn | |
| 6,120,202 A | * | 9/2000 | Donsky | A45D 34/045 401/17 |
| 6,145,515 A | * | 11/2000 | Wu | A45D 33/00 132/294 |
| 6,997,321 B2 | * | 2/2006 | Young | A45D 40/24 132/294 |

(Continued)

FOREIGN PATENT DOCUMENTS

| | | |
|---|---|---|
| EP | 0380182 A1 | 8/1990 |
| EP | 1797847 A1 | 6/2007 |
| FR | 2630896 A2 | 11/1989 |

OTHER PUBLICATIONS

International Search Report for PCT/EP2016/054036, dated May 27, 2016.

*Primary Examiner* — Steven A. Reynolds
(74) *Attorney, Agent, or Firm* — The Marbury Law Group, PLLC

(57) ABSTRACT

The present invention relates to a device (1) for packaging and applying at least one cosmetic product, comprising: —a container (2) delimiting at least two compartments (11, 12), —a closure cap (3) for closing the container (2), designed to close each compartment (11, 12) in a leaktight manner.

9 Claims, 2 Drawing Sheets

(56) References Cited

U.S. PATENT DOCUMENTS

| | | | | |
|---|---|---|---|---|
| 7,007,700 | B2 * | 3/2006 | Burroughs | A45C 11/008 132/294 |
| 7,028,843 | B2 * | 4/2006 | Byun | A45D 33/025 132/293 |
| 7,066,675 | B1 * | 6/2006 | Miller | A45D 29/007 401/126 |
| 9,908,672 | B2 * | 3/2018 | Massinello | A45D 34/046 |
| 2004/0194796 | A1 | 10/2004 | Burghaus | |
| 2005/0183984 | A1 * | 8/2005 | Shih | A45D 40/24 206/581 |
| 2011/0020047 | A1 * | 1/2011 | Kim | A45D 34/045 401/35 |

* cited by examiner

Section A-A

Section B-B

Detail C

Detail D

COSMETIC DEVICE HAVING LEAKTIGHT COMPARTMENTS

CROSS REFERENCE TO RELATED APPLICATIONS

This is a national stage application of PCT/EP2016/054036, filed internationally on Feb. 25, 2016, which claims priority to French Application No. 1551682, filed on Feb. 27, 2015, which are incorporated by reference herein in their entireties.

The present invention relates to devices for packaging and applying a cosmetic product, and more particularly but not exclusively a cosmetic product, in particular for the skin, eyes or lips.

The invention aims more particularly to improve devices that comprise a container defining a plurality of compartments, a closure cap for closing the container and optionally an applicator comprising an application element and a gripping member.

US675971 describes a container having two compartments that contain a brush and a product, respectively. The chamber which contains the brush also contains water for moistening the brush.

US2004194796 describes a container with two compartments, containing two different compositions which are intended to be dispensed and mixed during application.

U.S. Pat. No. 3,464,599 describes a container comprising a compartment intended to contain a liquid and a chamber inside this compartment. The chamber and the compartment comprise an elastic bottom. During use, an applicator is inserted into the chamber. By pushing the bottom with the applicator, the chamber and the compartment are brought into communication.

EP0380182 describes a container that defines a compartment in its middle for placing the applicator. In the variant illustrated in FIG. 4, the compartment is closed and can be opened so as to allow the product to pass through by virtue of a spring.

U.S. Pat. No. 5,242,232 describes a container comprising a tube that houses an applicator. The tube delimits narrow passages, which only allow a small quantity of liquid product to pass into the tube and to be absorbed by the applicator.

However, the devices described in these documents are:
- either complicated to manufacture,
- or not very leaktight.

There is a need to benefit from a device that makes it possible to ensure that the closure of the compartments of the container is leaktight.

There is also a need to benefit from a device that is simple to manufacture and is inexpensive.

There is also a need to benefit from a device which is practical to use, takes up little space and makes it possible to carry out neat application.

A subject of the invention, according to a first of its aspects, is a device for packaging and applying at least one cosmetic product, comprising:
- a container delimiting at least two compartments,
- a closure cap for closing the container, designed to close each compartment in a leaktight manner.

The device according to the invention can be produced in a relatively compact manner while being practical to use.

By virtue of the leaktight closure of each compartment, different cosmetic products can be stored and transported in the same device without being mixed. It is also possible to store a cosmetic product and an applicator separately in the same device. The space requirement is reduced. Storage and transport are simplified. Hygiene is improved. The products can be preserved for longer.

A further subject of the invention is a cosmetic treatment process comprising the application of a makeup or care product with the aid of a device as defined above.

The invention is very particularly suitable for the application of a compacted and/or cast product which can be cast or compacted directly in each compartment.

The container can be made of glass, thermoplastic material or other natural or synthetic materials.

The closure cap can be detachable entirely from the container to allow access to the product contained inside with the applicator.

The application element may be removable and washable. It may for example comprise a brush, a sponge, a spatula, a comb or a nonwoven.

Main Definitions

A "compartment" is understood to be a division made in a device in order to house cosmetic compositions or an applicator, separating them.

"A capsule is designed to close each compartment in a leaktight manner" means that when the cap is placed on the container, the contents of one compartment cannot migrate towards another compartment or escape from the device when the device is turned over for 1 minute, preferably 1 hour, more preferably 3 hours, the possible applicator being placed in the device. The pressure is 1 atmosphere and the temperature is equal to 20° C.

The "device is turned over" means that the bottom of the container is disposed above the cap.

A "leaktight zone" is a zone which prevents or helps to prevent the contents of the container from passing between:
- a compartment and the outside of the device, or
- one compartment and another, when the device is subjected to the above test.

"In one piece" means monolithic.

PREFERRED EMBODIMENTS

The device according to the invention may include one or more of the following features, taken separately or in any technically possible combination(s):
- The device comprises at least two leaktight zones.
- The container is in one piece.
- The leaktightness of each compartment is ensured by at least one seal or lip.
- An applicator is housed in one compartment.
- The compartments have parallel or coincident longitudinal axes.
- A cosmetic product in the form of a paste, gel or powder is housed in one compartment.
- The closure cap comprises a protruding handle.
- The container has a transparent wall.
- The product is a makeup product, in particular a foundation, blusher, eyeshadow, lipstick, lip gloss or lip balm

DESCRIPTION OF THE FIGURES

The invention may be better understood from reading the following detailed description of nonlimiting illustrative embodiments thereof and from examining the appended, schematic and partial drawing, in which:

FIGS. 1 to 9 show a device 1 of longitudinal axis X, produced in accordance with the invention, which comprises a container 2, a closure cap 3 and an applicator 4 which serves to pick up and apply the product.

Figure 3:
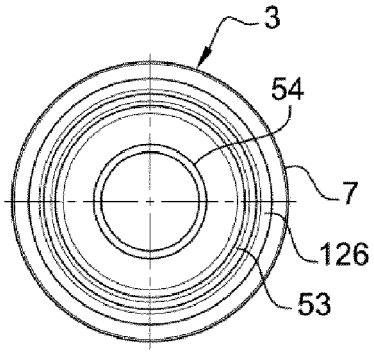
FIG. 3 is a bottom view of the cap in FIG. 2.
Figure 1:
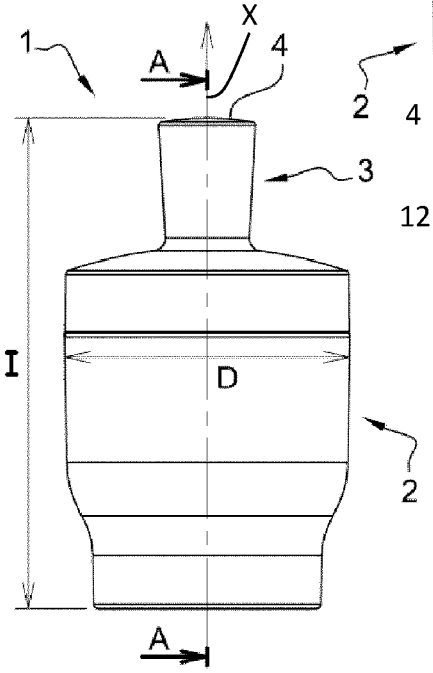
FIG. 1 shows a front view of a packaging and application device produced in accordance with the invention.
Figure 4:
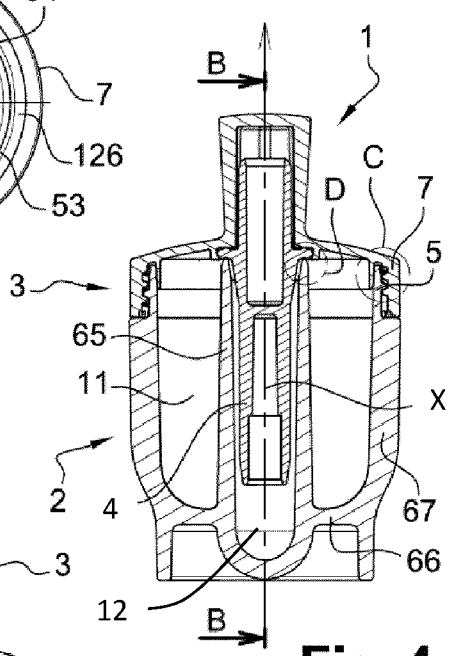
FIG. 4 is a section AA from FIG. 1.
Figure 5:
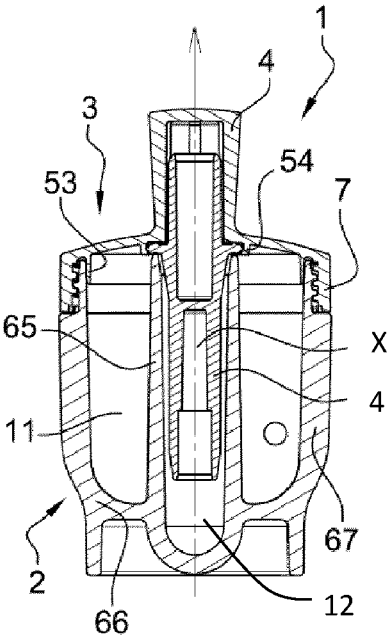
FIG. 5 is a section BB from FIG. 4.
Figure 6:
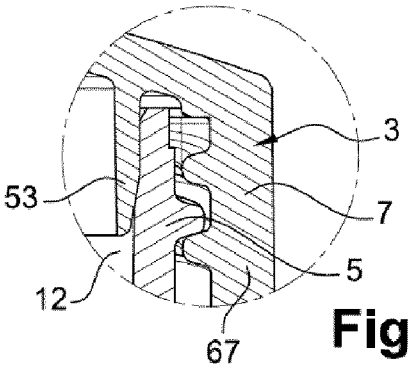
FIG. 6 shows the detail C from FIG. 4.
Figure 2:
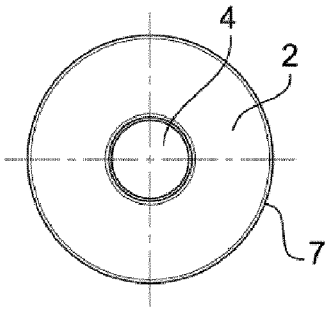
FIG. 2 is a top view of the cap of the device from FIG. 1.
Figure 7:
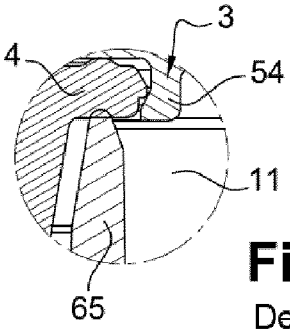
FIG. 7 shows the detail D from FIG. 4.
Figure 8:
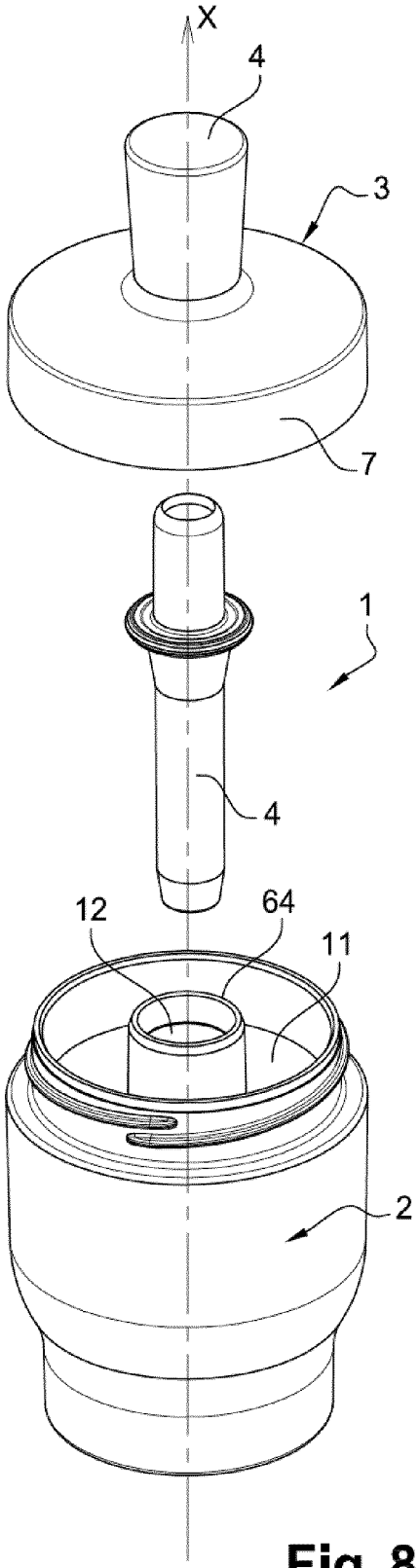
FIG. 8 is an exploded view of the device from FIG. 1.
Figure 9:
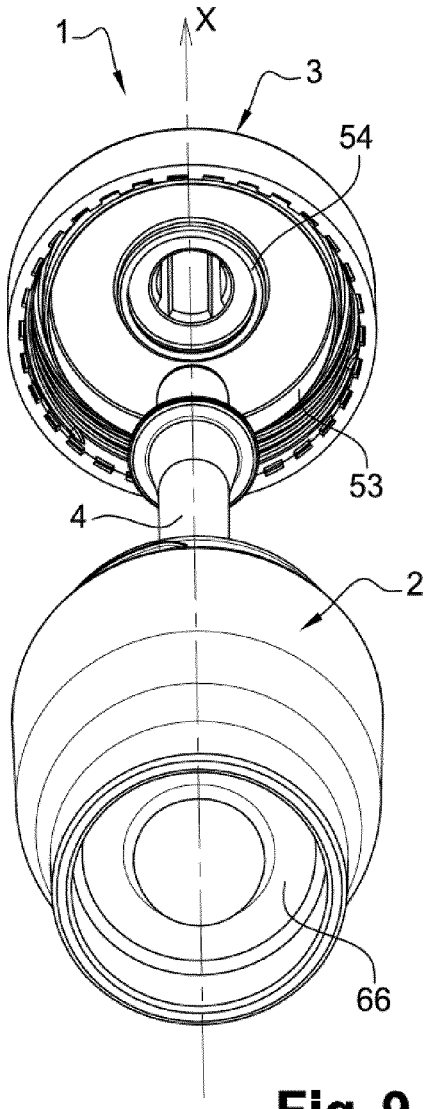
FIG. 9 is an oblique exploded view of the device from FIG. 1.

The container 2 comprises an external wall 67 with a substantially cylindrical shape. The height H of the device is 61.7 mm. The diameter D of the pot is 36.1 mm.

The container 2 is advantageously produced in one piece by molding thermoplastic material, for example a thermoplastic material chosen from polyolefins, polyamides, polyacetals, PET, and polystyrenes.

The closure cap 3 is for example screwed onto a threaded neck 5 of the container 2, but the closure cap 3 can be fixed on the container in various other ways, for example by snap-fastening, friction or a bayonet-type fastener.

The closure cap 3 can comprise a mounting skirt 7 that can be fixed to the neck 5 of the container in various ways, for example by screwing, as illustrated.

The closure cap 3 can be produced in one piece by molding thermoplastic material.

The container 2 can have a transparent wall that allows the user to see the color of the product for example.

The container 2 delimits two compartments:

an internal compartment 12 for housing the applicator 4, and an external compartment 11 for housing the product.

The cosmetic product may have been cast and/or compacted in the compartment 12.

The leaktightness of the closure of each compartment is ensured by a sealing lip:

the annular lip 53 ensures the leaktightness between the external compartment 11 and the outside of the device 1, the annular lip 54 ensures the leaktightness between the compartments 11 and 12.

The annular lip 53 surrounds the mounting skirt 7 and defines an annular groove 126 therewith.

The compartment 12 is delimited inside the container 2 by a cylindrical wall 65 of axis X that is closed at its lower end by the bottom wall 66 of the container.

In the closed position of the cap 3:

the applicator 4 comes into contact with the annular lip 54 and the cylindrical wall 65, the neck 5 of the container 2 comes into contact with the annular lip 53 and the external wall 67 of the container 2.

In order to use the device 1, the user can separate the closure cap 3 from the container 2, and then separate the applicator 4 from the compartment 12. They can use the applicator 4 to pick up the product from the compartment 11 and apply it to the skin or the lips. They can then insert the applicator into the compartment 12 and close the device 1 again by replacing the closure cap 3 on the container 2.

The invention is not limited to the exemplary embodiments that have just been described.

Provision can be made in particular of nonconcentric compartments or compartments that have other shapes in cross section.

Other applicators can be provided. The mirror can be fixed to the cap.

The expression "comprising a" is synonymous with "comprising at least one".

The invention claimed is:

1. A device for packaging and applying at least one cosmetic product, the device comprising:

a container comprising:

a threaded neck;

an external compartment; and an internal compartment disposed within the external compartment;

a closure cap configured to mate with the container and seal each of the internal and external compartments in a leaktight manner, such that the closure cap prevents mixing of contents of the internal and external compartments, and prevents the contents from escaping from the internal and external compartments when the container is turned over, the closure cap comprising:

a first annular lip configured to seal the external container;

a second annular lip configured to seal the internal container; and a mounting skirt configured to mate with the threaded neck; and an applicator configured to be housed in the internal compartment, wherein the threaded neck is configured to be disposed between the first annular lip and the mounting skirt, when the closure cap is mated with the container.

2. The device according to claim 1, wherein the container is in one piece.

3. The device according to claim 1, wherein the applicator extends from the closure cap and is configured to pick up a cosmetic product from the external container.

4. The device according to claim 1, wherein the internal and external compartments have coincident longitudinal axes.

5. The device according to claim 1, further comprising a cosmetic product in the form of a paste, gel, or powder housed in the external compartment.

6. The device according to claim 1, wherein the closure cap comprises a protruding handle.

7. The device according to claim 1, wherein the container comprises at least one transparent wall.

8. The device according to claim 1, further comprising a cosmetic product chosen from a makeup product, foundation, blusher, eyeshadow, lipstick, lip gloss, or lip balm.

9. A cosmetic process comprising:

applying a makeup or care product with the aid of a device; wherein the device comprises:

a container comprising:

a threaded neck;

an external compartment; and an internal compartment disposed within the external compartment;

a closure cap configured to mate with the container and close the internal and external compartments in a leaktight manner, such that the closure cap prevents mixing of contents of the internal and external compartments, and prevents the contents from escaping from the internal and external compartments when the container is turned over, the closure cap comprising:

a first annular lip configured to seal the external container;

a second annular lip configured to seal the internal container; and a mounting skirt configured to mate with the threaded neck; and an applicator configured to be housed in the internal compartment, wherein the threaded neck is configured to be disposed between the first annular lip and the mounting skirt, when the closure cap is mated with the container.

* * * * *